US009703243B2

(12) United States Patent
Swantner et al.

(10) Patent No.: US 9,703,243 B2
(45) Date of Patent: Jul. 11, 2017

(54) TONER CARTRIDGE

(71) Applicant: Hewlett-Packard Development Company, L.P., Houston, TX (US)

(72) Inventors: Richard L. Swantner, Boise, ID (US); Robin P. Yergenson, Boise, ID (US); Dean J. Richtsmeier, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/000,969

(22) Filed: Jan. 19, 2016

(65) Prior Publication Data

US 2016/0132012 A1 May 12, 2016

Related U.S. Application Data

(63) Continuation of application No. 14/235,061, filed as application No. PCT/US2011/048437 on Aug. 19, 2011, now Pat. No. 9,244,381.

(51) Int. Cl.

*G03G 15/08* (2006.01)
*G03G 15/00* (2006.01)
*G03G 21/18* (2006.01)

(52) U.S. Cl.

CPC ..... *G03G 15/50* (2013.01); *G03G 15/0865* (2013.01); *G03G 21/1814* (2013.01); *G03G 21/1835* (2013.01)

(58) Field of Classification Search

CPC ..... G03G 15/50; G03G 15/0865; G03G 21/1814; G03G 21/1835

See application file for complete search history.

(56) References Cited

U.S. PATENT DOCUMENTS 3,985,436 A * 10/1976 Tanaka ..... G03G 21/1857 399/111
4,538,896 A * 9/1985 Tajima ..... G03G 21/1817 399/102
4,647,180 A 3/1987 Watanabe
4,766,457 A 8/1988 Barker et al.

(Continued)

FOREIGN PATENT DOCUMENTS

CN 1702571 11/2005
CN 1763659 4/2006

(Continued)

OTHER PUBLICATIONS

European Patent Office, "Extended European Search Report", issued in connection with European Patent Application No. 11871357.7, issued on Jun. 5, 2015, 10 pages.

(Continued)

*Primary Examiner* — David Bolduc
(74) *Attorney, Agent, or Firm* — HP Inc. Patent Department

(57) ABSTRACT

Printers are disclosed herein. An example printer includes a housing; a non-refillable toner container permanently affixed within the housing, the toner container having a capacity sufficient to store enough toner to print a first number of pages that corresponds to an expected useful life of the printer; and a processor responsive to an input to enable a second number of pages to be printed by the printer, the second number of pages being less than the first number of pages.

10 Claims, 20 Drawing Sheets

(56) References Cited

U.S. PATENT DOCUMENTS 5,083,166 A * 1/1992 Hill ..... G03G 15/0877 399/119
5,369,429 A * 11/1994 Erickson ..... B41J 2/175 347/7
5,675,367 A * 10/1997 Scheffelin ..... B41J 2/17506 347/85
5,815,767 A * 9/1998 Kutsuwada ..... G03G 5/147 399/111
5,909,609 A 6/1999 Yahata et al.
6,023,594 A 2/2000 Okiyama et al.
6,081,676 A 6/2000 Inomata
6,553,189 B2 4/2003 Miyamoto et al.
6,681,088 B2 1/2004 Kanno et al.
6,783,218 B2 8/2004 Cheok
6,983,114 B2 1/2006 Arimitsu
7,050,728 B2 5/2006 Minagawa et al.
7,123,865 B2 10/2006 Kita
7,138,215 B2 11/2006 Oya et al.
7,146,115 B2 12/2006 Suzuki et al.
7,162,174 B2 1/2007 Suzuki et al.
7,270,494 B2 * 9/2007 Silverbrook ..... B41J 2/17513 400/634
7,334,884 B2 2/2008 Shiota
7,433,622 B2 10/2008 Chadani et al.
7,496,323 B2 2/2009 Kataoka et al.
7,505,711 B2 3/2009 Yoshimoto et al.
7,509,071 B2 3/2009 Yoshimura et al.
7,515,853 B2 4/2009 Kimura et al.
7,515,855 B2 4/2009 Katsuyama et al.
7,639,966 B2 12/2009 Sato et al.
7,689,157 B2 3/2010 Tanaka
7,693,477 B2 4/2010 Chatani et al.
7,848,682 B2 12/2010 Tanaka
7,853,185 B2 12/2010 Kimura et al.
7,962,063 B2 6/2011 d'Entrecasteaux
8,170,447 B2 5/2012 Kubo et al.
2003/0086715 A1 5/2003 Miura et al.
2003/0156848 A1 8/2003 Kawai et al.
2004/0125397 A1 * 7/2004 Adkins ..... G06F 21/10 358/1.14
2005/0030554 A1 * 2/2005 Dixon ..... B41J 29/38 358/1.1
2005/0100368 A1 5/2005 Matsuzaki
2005/0232653 A1 10/2005 Murooka
2005/0241001 A1 * 10/2005 Parry ..... G06F 21/608 726/27
2005/0265745 A1 12/2005 Takesawa et al.
2006/0062595 A1 3/2006 Nousho et al.
2006/0083552 A1 4/2006 Yoshimoto et al.
2006/0216063 A1 9/2006 Okoshi
2006/0216067 A1 9/2006 Okoshi
2006/0216083 A1 9/2006 Okoshi
2006/0222412 A1 10/2006 Ito et al.
2006/0257174 A1 11/2006 Tsunemi et al.
2006/0275051 A1 12/2006 Daniels
2006/0280513 A1 * 12/2006 Hatakeyama ..... G03G 15/553 399/27
2007/0015078 A1 1/2007 Suzuki et al.
2007/0024688 A1 * 2/2007 Rochford ..... B41J 29/026 347/108
2007/0258732 A1 11/2007 Tanaka
2007/0264051 A1 11/2007 Tanaka
2008/0056771 A1 3/2008 Chatani et al.
2008/0056775 A1 3/2008 Ishihara
2008/0089729 A1 * 4/2008 Fujita ..... G03G 15/55 400/76
2008/0090164 A1 4/2008 Takeda et al.
2008/0152386 A1 6/2008 Sakaguchi et al.
2008/0181692 A1 7/2008 Tatsumi et al.
2008/0187357 A1 8/2008 Miura et al.
2008/0226310 A1 * 9/2008 Togami ..... G03G 15/553 399/27
2008/0259112 A1 10/2008 Olsen et al.
2009/0041500 A1 2/2009 Mitsumori et al.
2009/0142092 A1 6/2009 Sato
2009/0190937 A1 * 7/2009 Willis ..... G03G 15/55 399/27
2010/0035171 A1 2/2010 Watanabe et al.
2010/0054764 A1 * 3/2010 Nishikawa ..... G03G 15/553 399/27
2010/0054815 A1 3/2010 Okimura et al.
2010/0074649 A1 3/2010 Kondo
2010/0272474 A1 10/2010 Sato
2011/0052268 A1 3/2011 Mano et al.
2011/0299873 A1 12/2011 Ushiozu et al.
2011/0299882 A1 12/2011 Tanaami et al.
2012/0039622 A1 2/2012 Cho
2012/0114385 A1 5/2012 Tsumita
2012/0148271 A1 6/2012 Fukita et al.
2013/0129389 A1 * 5/2013 Moon ..... G03G 15/0189 399/258
2014/0093257 A1 4/2014 Seto
2014/0153971 A1 6/2014 Swantner et al.

FOREIGN PATENT DOCUMENTS

CN 101135878 3/2008
EP 1953605 A2 8/2008
EP 1953605 A3 1/2011
JP 61156177 7/1986
JP 2000199993 7/2000
JP 2002307705 10/2002
JP 2003295592 10/2003
JP 2008020788 1/2008
JP 2008129210 6/2008
JP 2009204999 9/2009
JP 2009222858 10/2009
JP 2010143069 7/2010
KR 100248179 3/2000
KR 20080072577 8/2008

OTHER PUBLICATIONS

United States Patent and Trademark Office, "Restriction Requirement", issued in connection with U.S. Appl. No. 14/235,061, mailed on Dec. 16, 2014, 8 pages.
United States Patent and Trademark Office, "Non-Final Office Action", issued in connection with U.S. Appl. No. 14/235,061, mailed on Apr. 7, 2015, 30 pages.
United States Patent and Trademark Office, "Notice of Allowance", issued in connection with U.S. Appl. No. 14/235,061, mailed on Oct. 1, 2015, 27 pages.
Patent Cooperation Treaty, "International Search Report", issued in connection with PCT Patent Application No. PCT/US2011/048437, mailed Feb. 27, 2012, 3 pages.
Patent Cooperation Treaty, "Written Opinion", issued in connection with PCT Patent Application No. PCT/US2011/048437, mailed Feb. 27, 2012, 4 pages.
Patent Cooperation Treaty, "International Preliminary Report on Patentability", issued in connection with PCT Patent Application No. PCT/US2011/048437, mailed Feb. 25, 2014, 5 pages.

* cited by examiner

TONER CARTRIDGE

RELATED APPLICATION

This patent arise from a continuation of U.S. patent application Ser. No. 14/235,061, filed on Jan. 26, 2014, which is a national stage entry of PCT/US2011/048437, filed on Aug. 19, 2011. Priority is claimed to U.S. patent application Ser. No. 14/235,061 and PCT/US2011/048437. Patent application Ser. No. 14/235,061 and PCT/US2011/048437 are incorporated herein by reference in their entries.

BACKGROUND

The printing process used in many laser printers and other such electrophotographic printers involves applying a uniform surface charge to a photoconductor and then exposing the photoconductor to imaging light that discharges the photoconductor in select areas to define a latent electrostatic image on the photoconductor. The latent image is developed by depositing toner on the surface of the photoconductor. The toner adheres to the imaged areas of the photoconductor to form a developed image that is transferred to paper or another imaging substrate. The toner supply is usually contained in a replaceable cartridge that sometimes also houses the photoconductor and other image development components of the printer.

DRAWINGS

Figure 17:
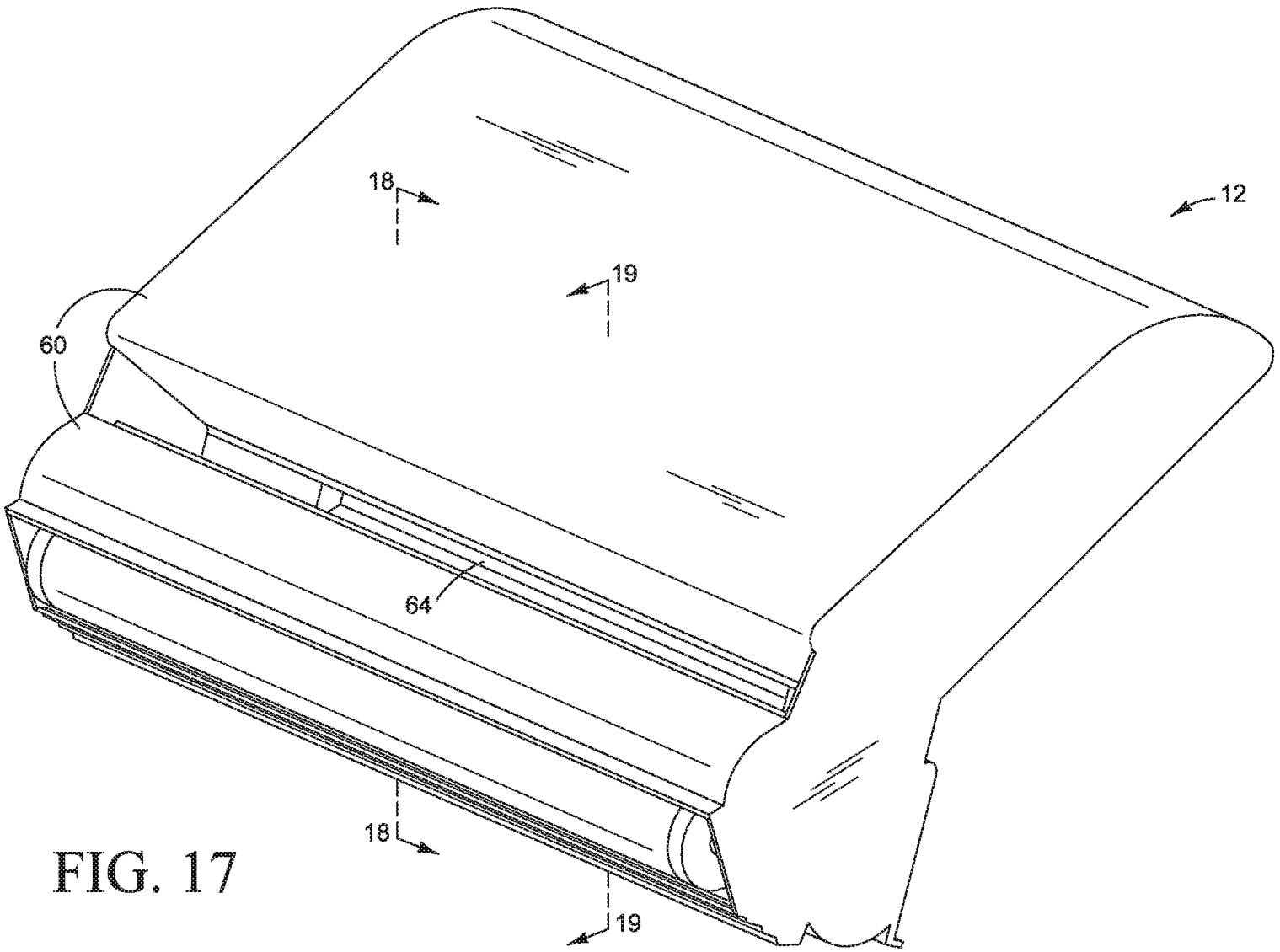
FIG. 17 is a perspective view of the toner container in the printer of FIG. 16.
Figure 18:
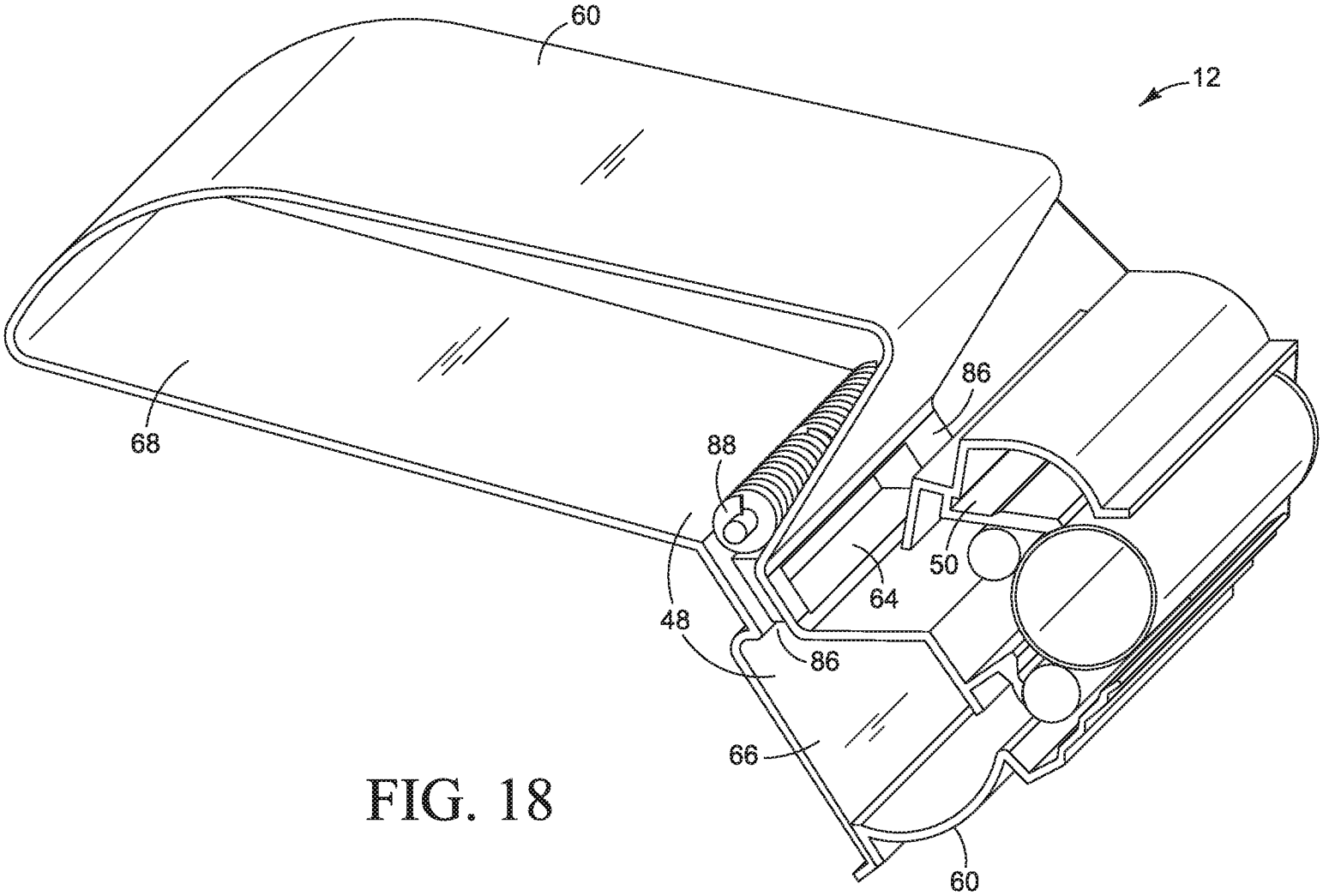
Figure 19:
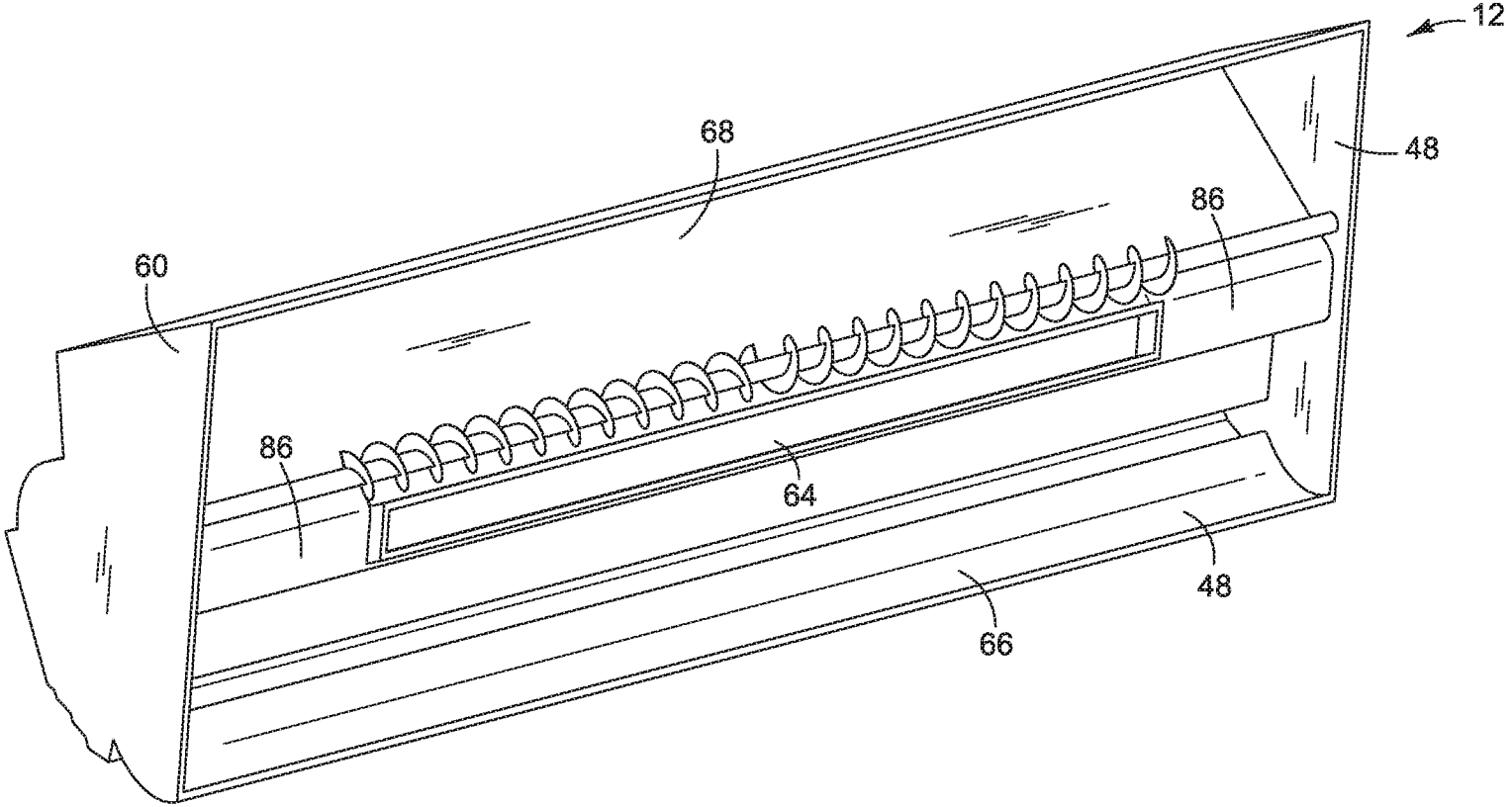

FIGS. 18 and 19 are section views taken along the lines 18-18 and 19-19 in FIG. 17.

The section views have been simplified in some instances to better illustrate certain features, for example by omitting cross-hatching and some background structures. The same part numbers are used to designate the same or similar parts throughout the figures.

DESCRIPTION

Examples of the present invention were developed to increase the toner supply capacity in some electrophotographic printers without also increasing the size of the printer (or to reduce the size of the printer needed to accommodate an increased toner supply capacity). A larger toner supply reduces the need for the user to purchase replacement toner supply cartridges over the expected useful life of the printer. In some examples, a new toner supply container is sufficiently enlarged to eliminate the need for the user to replace the original toner container without also increasing the size of the printer. In such examples, the toner container may be configured as a non-removable component that simplifies printer construction, and simplifies user operation by eliminating the need to remove a spent toner cartridge and replace it with a new toner cartridge. Also, as a non-removable component, the toner container may be integrated into the printer structure as a load bearing member and/or as part of the printer exterior, thus replacing conventional discrete load bearing structures and/or exterior features.

Some examples of the new toner container facilitate the implementation of a novel printer use model in which printing capacity may be purchased incrementally, as desired, to help the user control printing costs. In these examples, the same toner container may be used for both fixed page count printers in which only the amount of toner needed to satisfy the fixed page count is supplied with the printer, or for variable page count printers in which the user may purchase access to additional printing capacity using toner originally supplied with the printer.

Examples of a new toner container and new printer configurations will be described with reference to an electrophotographic printer with an imaging light path typical of a scanning laser printer in which enlarging the toner container may be particularly challenging. Examples of the new toner container and the new printer configurations, however, are not limited to scanning laser printers. Examples might also be implemented in LED scan bar and other types of electrophotographic printers. "Printer" as used in this document means any printing device including but not limited to "printers", "copiers", MFPs (multi-function printers), and AiOs (all-in-one printers). The examples shown in the figures and described below illustrate but do not limit the invention, which is defined in the Claims following this Description.

Figure 1:
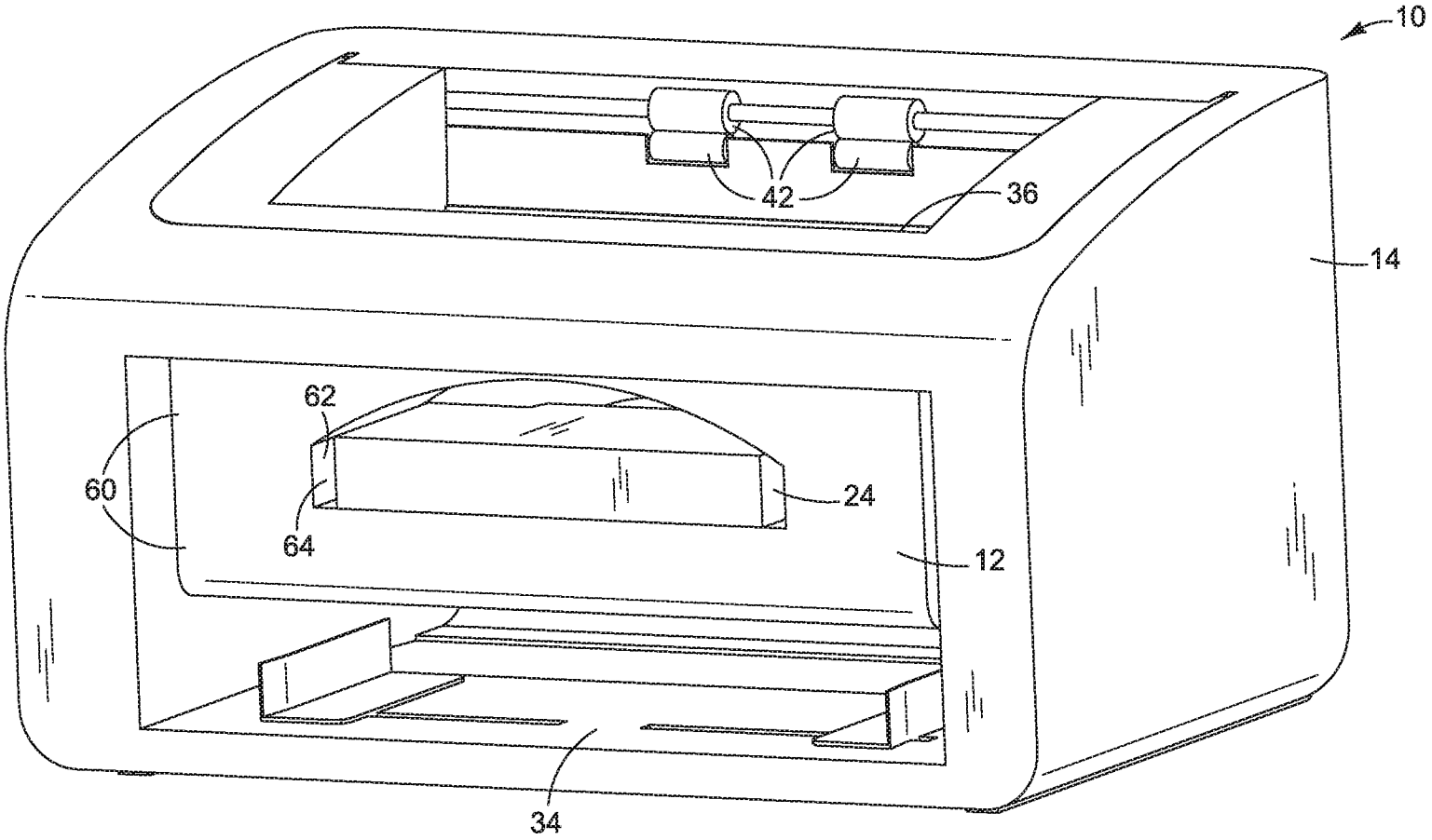
FIGS. 1 and 2 are perspective and side views, respectively, illustrating one example of a toner container for an electrophotographic printer.
Figure 2:
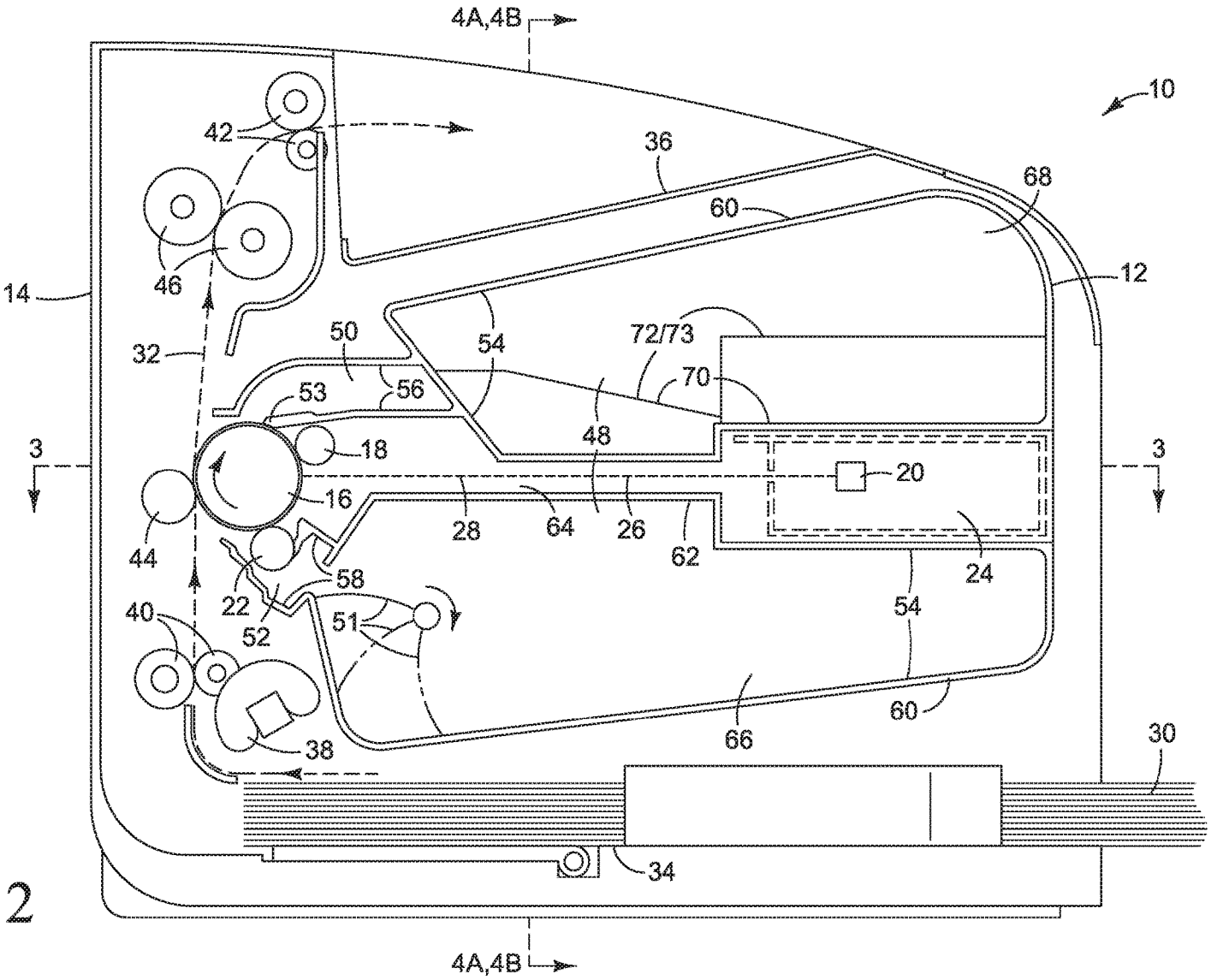

FIGS. 1 and 2 are perspective and elevation views, respectively, illustrating an electrophotographic printer 10 with a toner container 12. Referring to FIGS. 1 and 2, printer 10 includes a housing 14 that forms the exterior of printer 10 and generally supports the operative components of printer 10. Printer "housing" as used in this document includes load bearing and other supporting structures in the printer as well as the exterior features of the printer. In many electrophotographic printers a uniform surface charge is applied to a photoconductor and then the photoconductor is exposed to imaging light that discharges the photoconductor in select areas to define a latent electrostatic image on the photoconductor. The latent image is developed by depositing toner on the surface of the photoconductor. The toner adheres to the imaged areas of the photoconductor to form a developed image that is transferred to paper or another imaging substrate.

Thus, and referring specifically to FIG. 2, printer 10 includes: a photoconductor roller 16 that has a photoconductive surface on which the latent image is formed and the toner image is developed; a charging roller 18 for applying a uniform surface charge to photoconductor 16; a laser or other suitable light source 20 for exposing photoconductor 16 to imaging light for discharging photoconductor 16 in the desired pattern; and a developer roller 22 for applying toner to photoconductor 16. Although the photoconductive element 16, the charging device 18, and the developer unit 22 are shown as rollers, other suitable mechanisms or configurations for each element may be used. The configuration of printer 10 in FIG. 2, therefore, illustrates just one example configuration for these operative elements of an electrophotographic printer. Also, although the configuration of printer 10 in FIG. 2 represents a monochrome printer, this and other examples of a new toner container 12 may be implemented in a color printer.

In the example shown in FIGS. 1 and 2, light source 20 is housed in a module 24 that may also house, for example, a lens, a mirror, circuitry, and/or other components needed to accurately project a beam of light 26 along a horizontal light path 28 onto photoconductor 16.

Referring again specifically to FIG. 2, a sheet of paper or other print substrate is picked from a stack 30 and fed along a substrate path 32 from an input tray 34 to an output tray 36. Each substrate sheet is picked from stack 30 and fed along path 32 using, for example, a pick roller 38, feed rollers 40 and output rollers 42. Toner is applied to each sheet as it passes between photoconductor 16 and a transfer roller 44. For a dry toner electrophotographic printing process, the toner is affixed to the sheet as it passes through a nip between fusing rollers 46 which apply heat and pressure simultaneously to the print substrate.

Figure 3:
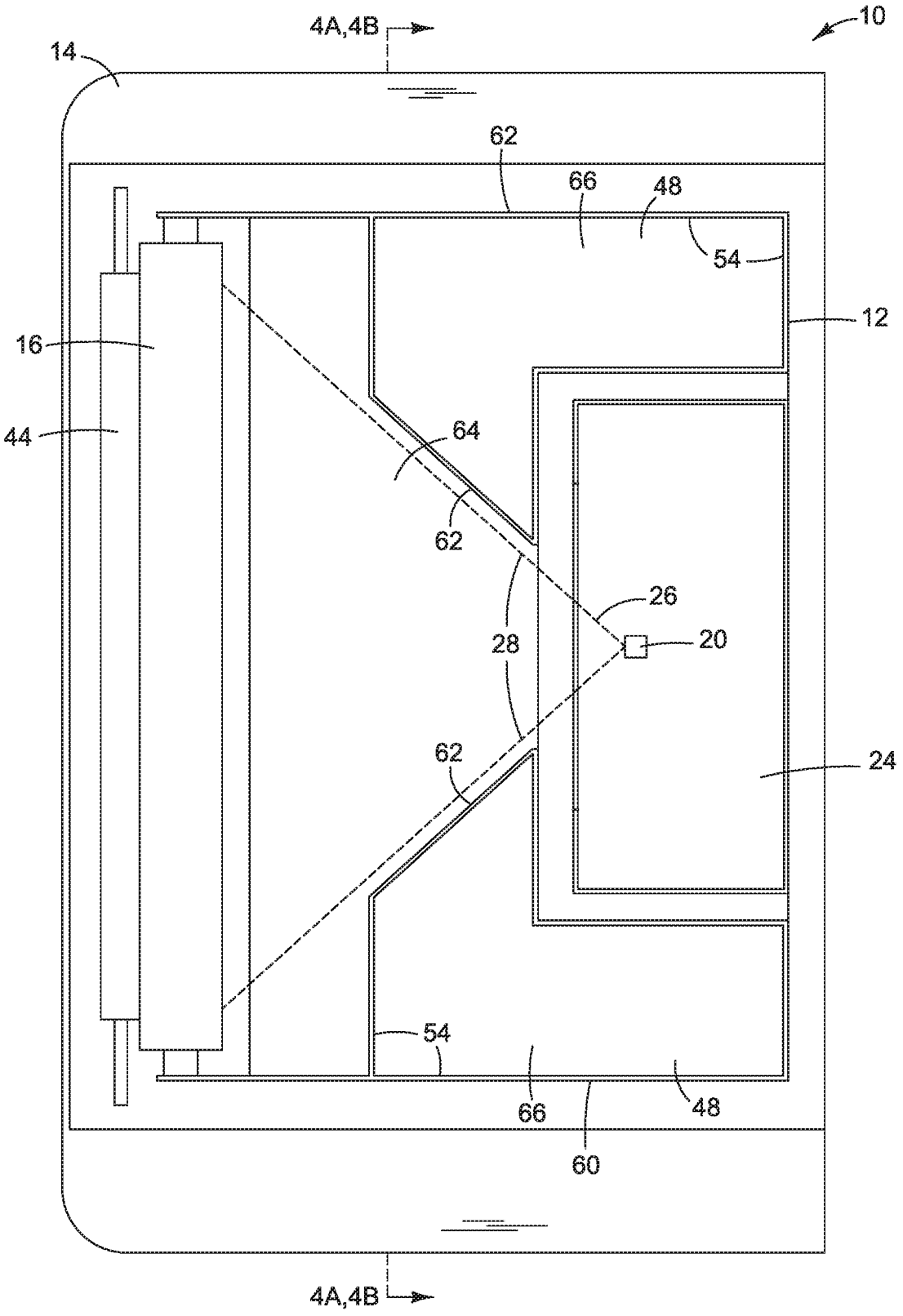
FIG. 3 is a section view taken along the line 3-3 in FIG. 2.
Figure 4A:
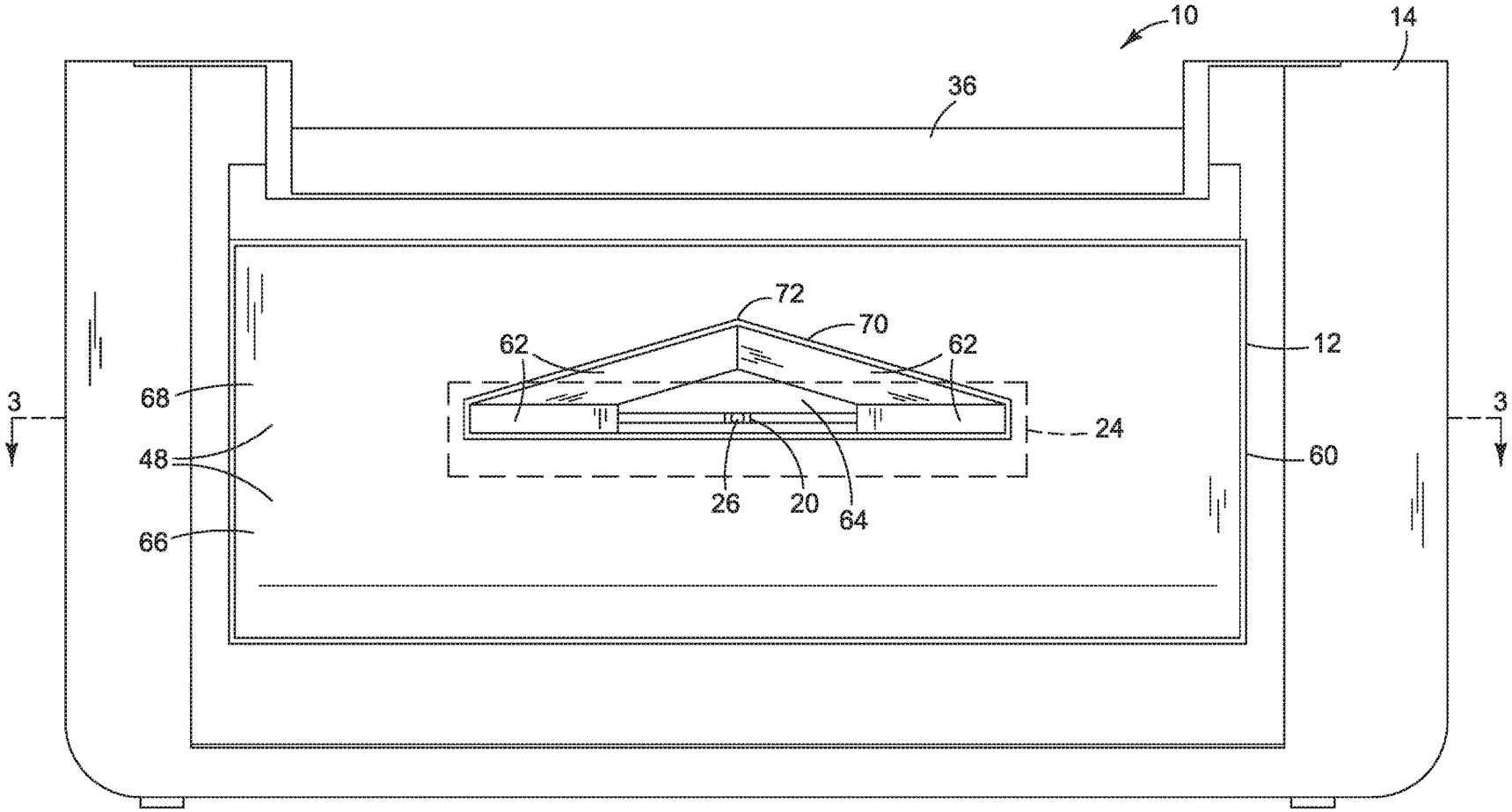
FIGS. 4A and 4B are section views taken along the line 4A/4B-4A/4B in FIG. 2 illustrating two example configurations for the upper chamber in the toner container shown in FIGS. 1 and 2.
Figure 4B:
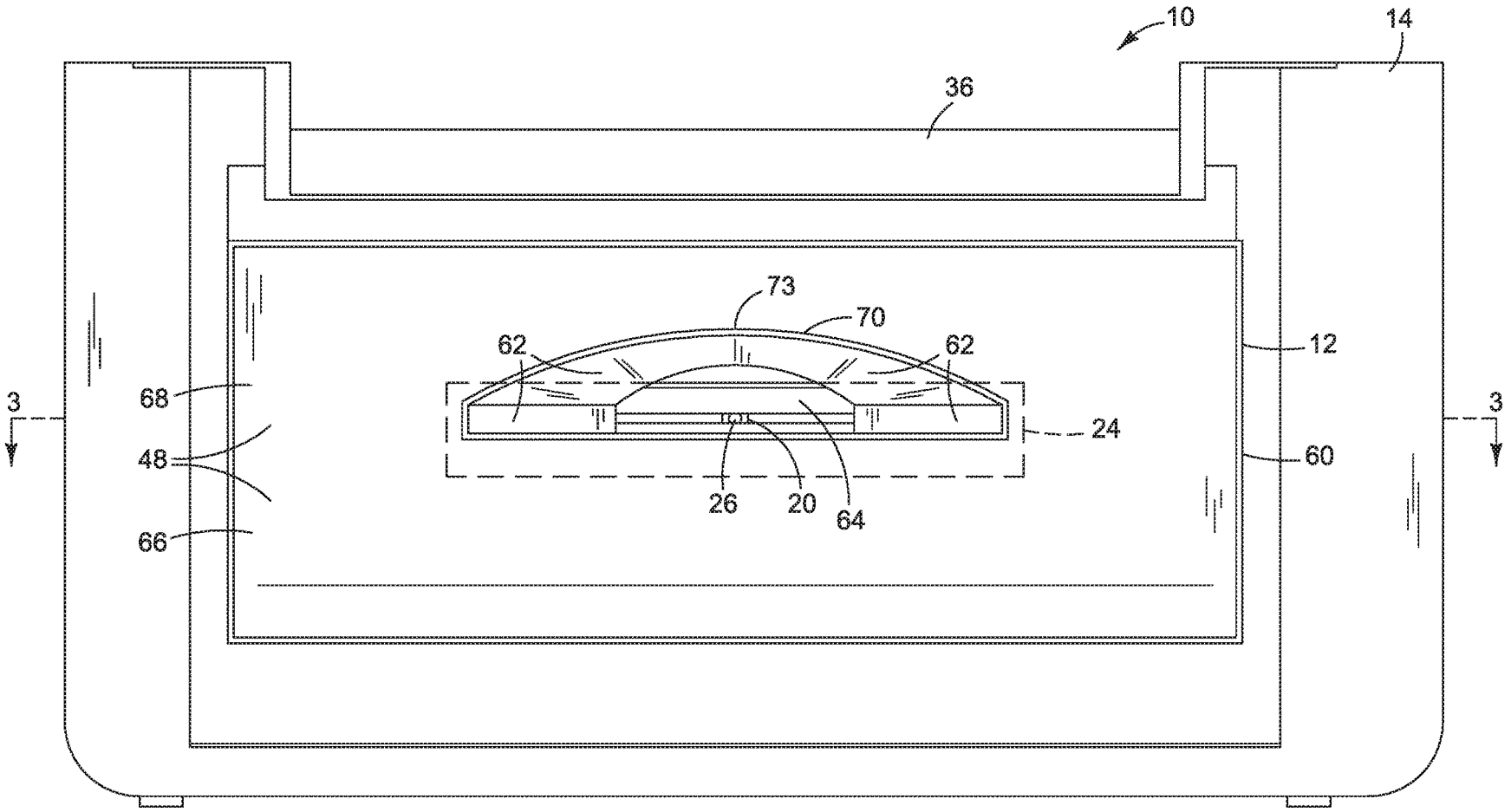
Figure 5:
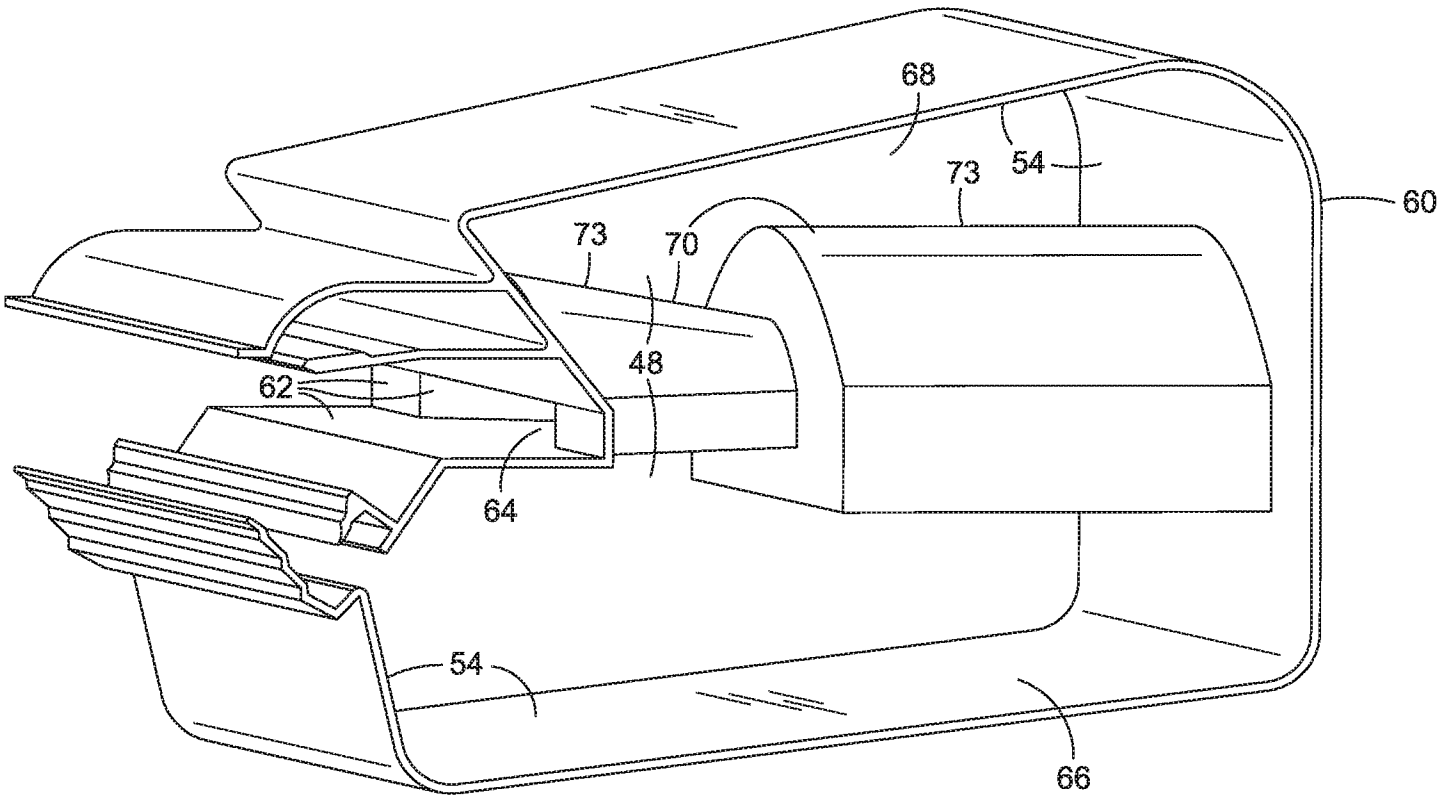
FIGS. 5 and 6 are side and section perspective views, respectively, illustrating the housing for the toner container of FIGS. 1-3 in the domed configuration of FIG. 4B.
Figure 6:
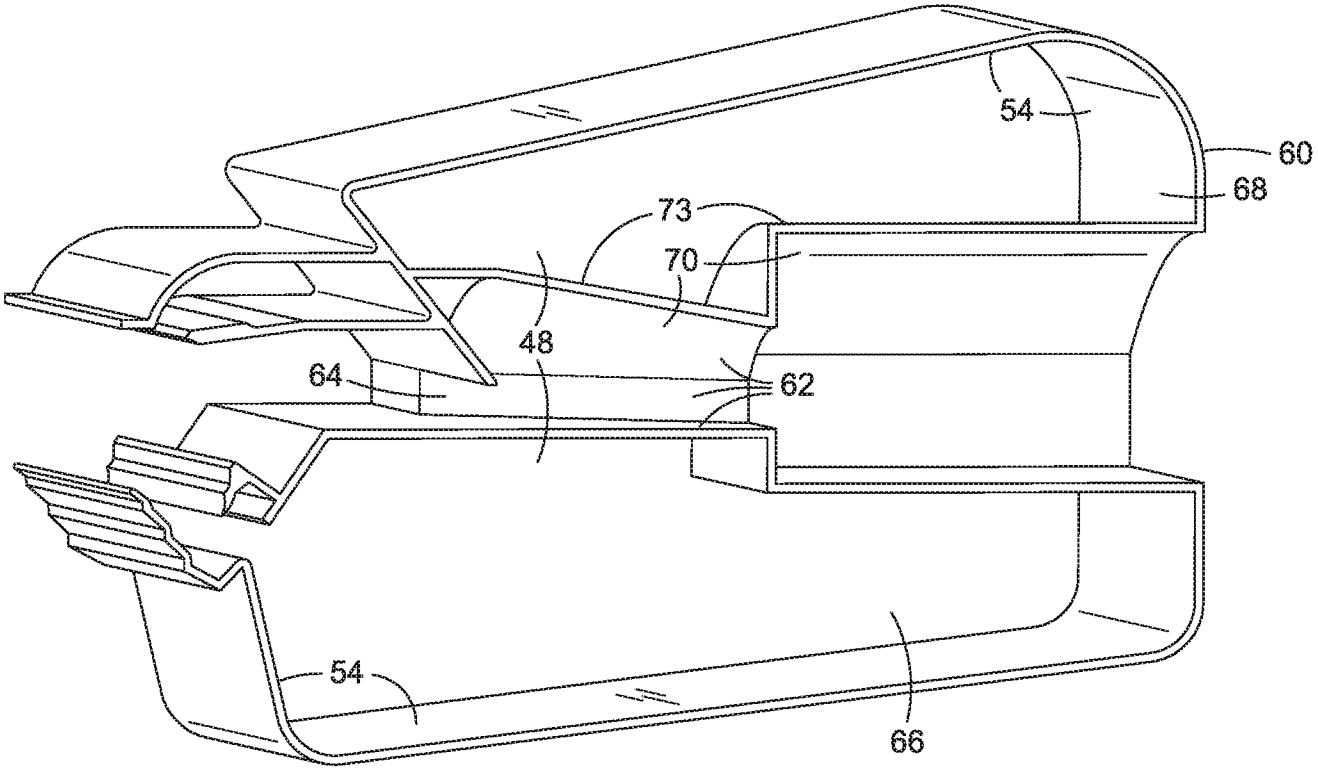

FIG. 3 is a section view taken along the line 3-3 in FIG. 2. FIGS. 4A and 4B are section views taken along the line 4A/4B-4A/4B in FIG. 2 illustrating two example configurations for part of container 12. FIGS. 5 and 6 are side and section perspective views, respectively, illustrating the housing for toner container 12 in the domed configuration of FIG. 4B. Referring now to FIGS. 2-6, toner container 12 includes a toner supply reservoir 48 for holding fresh toner, a waste reservoir 50 for holding used toner, and a hopper 52 from which fresh toner is supplied directly to developer roller 22. A rotating paddle 51 in reservoir 48 sweeps fresh toner from supply reservoir 48 into hopper 52. (The rotation of paddle 51 is indicated by a direction arrow and dotted lines in FIG. 2.) A cleaning blade 53 scrapes residual toner off the rotating photoconductor 16 into waste toner reservoir 50. Reservoirs 48, 50 and hopper 52 are defined by respective interior regions 54, 56, and 58 of a container housing 60. An exterior region 62 of housing 60 defines an opening 64 surrounding light path 28 that allows imaging light beam 26 to pass unobstructed to photoconductor 16.

Toner supply reservoir 48 may be characterized as having interconnected lower and upper chambers 66 and 68. Lower chamber 66 lies below lighting module 24 and imaging light path 28 and extends longitudinally from hopper 52 near photoconductor 16 at the rear of printer 10 forward to near the front of printer 10. Thus, lower chamber 66 extends longitudinally a distance greater than the length of light path 28. (The length of light path 28 is defined by the distance along a straight line radially out from photoconductor 16 to light source 20.)

As best seen in FIG. 3, lower chamber 66 and upper chamber 68 extend laterally a width substantially equal to or greater than the axial length of photoconductor 16. "Substantially" as used in this document for describing the width of toner supply reservoir 48 or the width of one of the chambers in toner supply reservoir 48 means the width of imaging light that can be projected on to photoconductor 16. Lower chamber 66, therefore, is configured to occupy substantially the full volume of available space below light path 28 and lighting module 24, and toner supply reservoir 48, including both chambers 66 and 68, is configured to occupy substantially the full volume of available space around light path 28.

As best seen in FIG. 3, imaging light beam 26 is scanned or otherwise projected across substantially the full axial length of photoconductor 16 to form a wedge shaped light path 28. A similarly wedge shaped opening 64 in container 12 helps maximize the capacity of reservoir 48. In the configurations shown in FIGS. 4A and 4B, the floor 70 of upper chamber 68 (which is the ceiling of opening 64) is shaped to allow toner in upper chamber 68 to flow passively (under the influence of gravity) into lower chamber 66. In the configuration of FIG. 4A, upper chamber floor 70 forms a peak 72 to urge toner down along floor 70 toward lower chamber 66. In the configuration shown in FIG. 4B, upper chamber floor 70 forms a dome 73 to urge toner down along floor 70 toward lower chamber 66.

Referring again to FIG. 2, in this example for container 12, the imaging system components may be housed together as part of a removable cartridge in which photoconductor 16, charging roller 18 and developer roller 22 are permanently affixed to container housing 60 at the rear of the cartridge. Imaging light module 24 is housed at the front of the cartridge in a pocket surround by reservoir 48. Light module 24 may itself be a removable component detachable from container housing 60, or light module 24 may be permanently affixed to container housing 60. Other configurations are possible. For one example, container 12 may be separate from the imaging system components to function solely as a toner supply reservoir, either as a removable cartridge or as a non-removable supply container.

For less expensive, lower volume printers 10, an enlarged toner supply reservoir 48 such as that shown in FIGS. 1-6 can have sufficient capacity to store enough toner to print a minimum number of pages that corresponds to a predetermined expected useful life of the printer. "Predetermined" in this context means a determination of expected useful life made before the printer is put into service, for example by the manufacturer as part of the specifications for the printer. In one example for an inexpensive laser printer designed for personal and small business use, the predetermined expected useful life of the printer may be about 30,000 printed pages. The configuration of toner container 12 and supply reservoir 48 shown in FIGS. 1-6 used in such a printer could easily store enough toner to print 30,000 pages, thus supplying toner for printing throughout the predetermined expected useful life of the printer.

Figure 7:
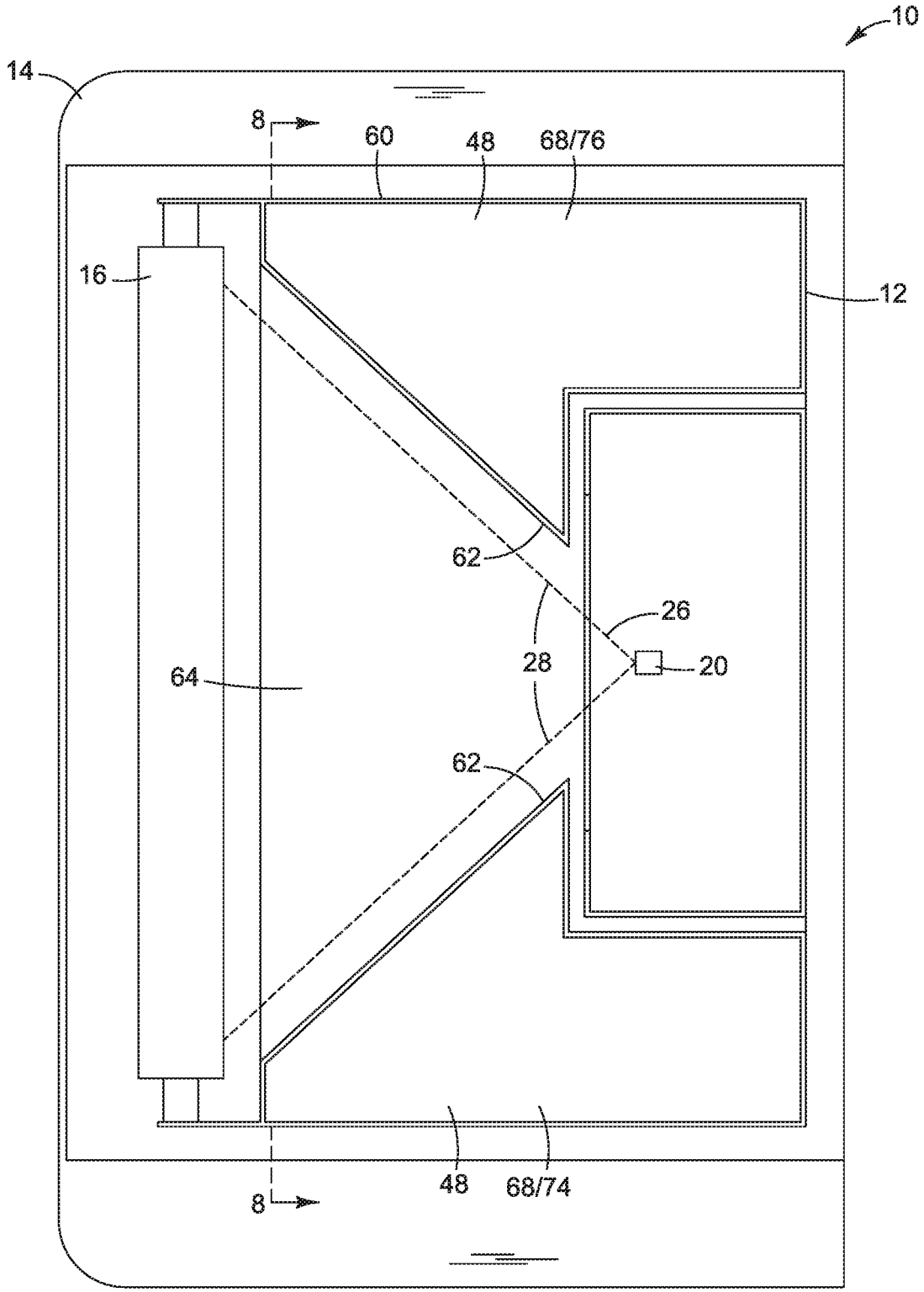
FIGS. 7 and 8 are plan and front section views, respectively, illustrating another example of a toner container for an electrophotographic printer in which the toner supply chamber includes towers along each side of the imaging light path.
Figure 8:
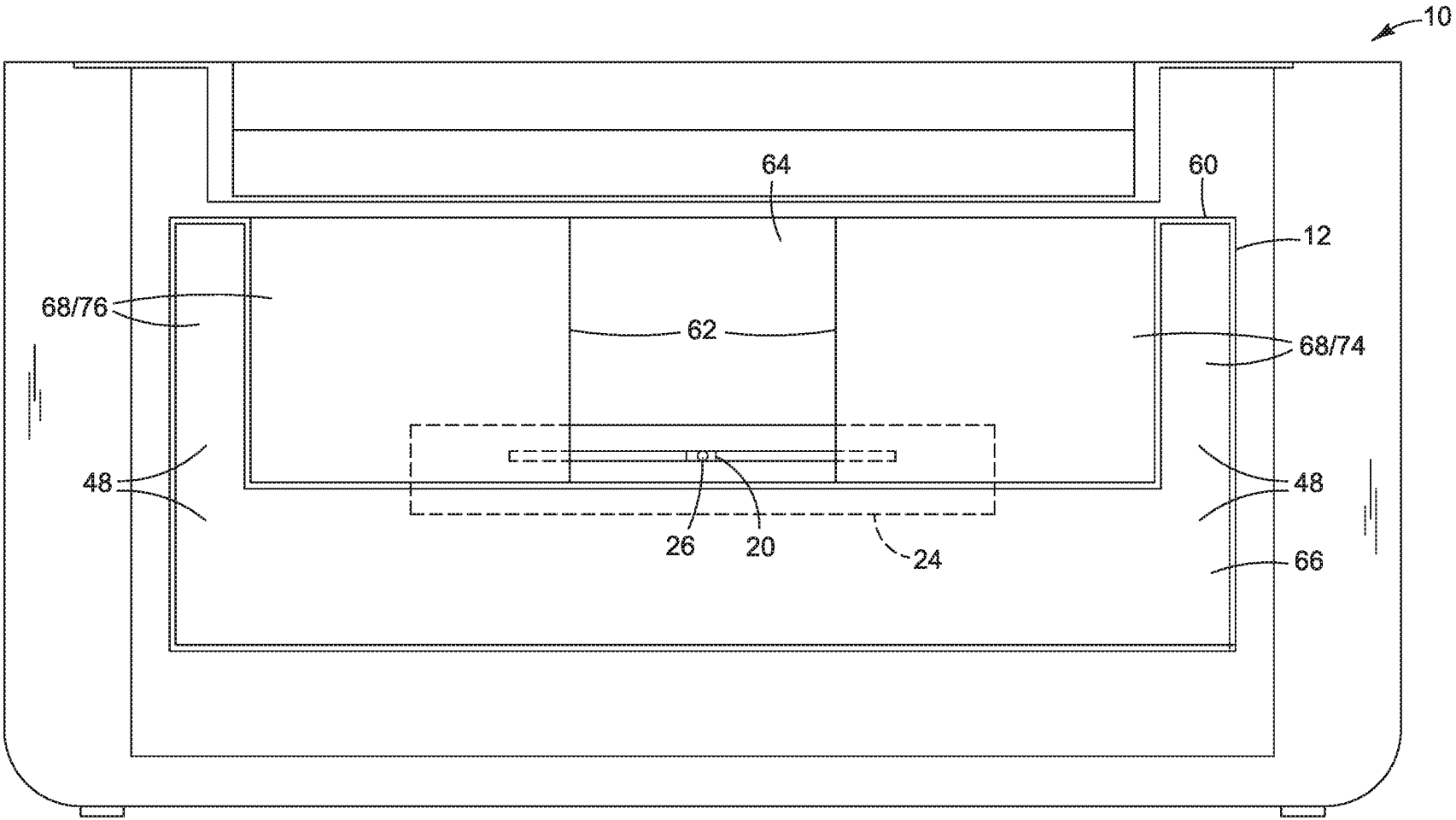

FIGS. 7 and 8 are plan and elevation views, respectively, illustrating another example of a toner container 12 in which toner supply reservoir 48 includes towers 74, 76 along each side of light path 28. Thus, in this example, reservoir upper chamber 68, defined by towers 74 and 76, does not extend over light path 28. Although the tower configuration of FIGS. 7 and 8 may provide less storage capacity than the configuration shown in FIGS. 1-3, it has the advantage of a more simple design that allows toner to move from upper chamber 68 into lower chamber 66.

Figure 9:
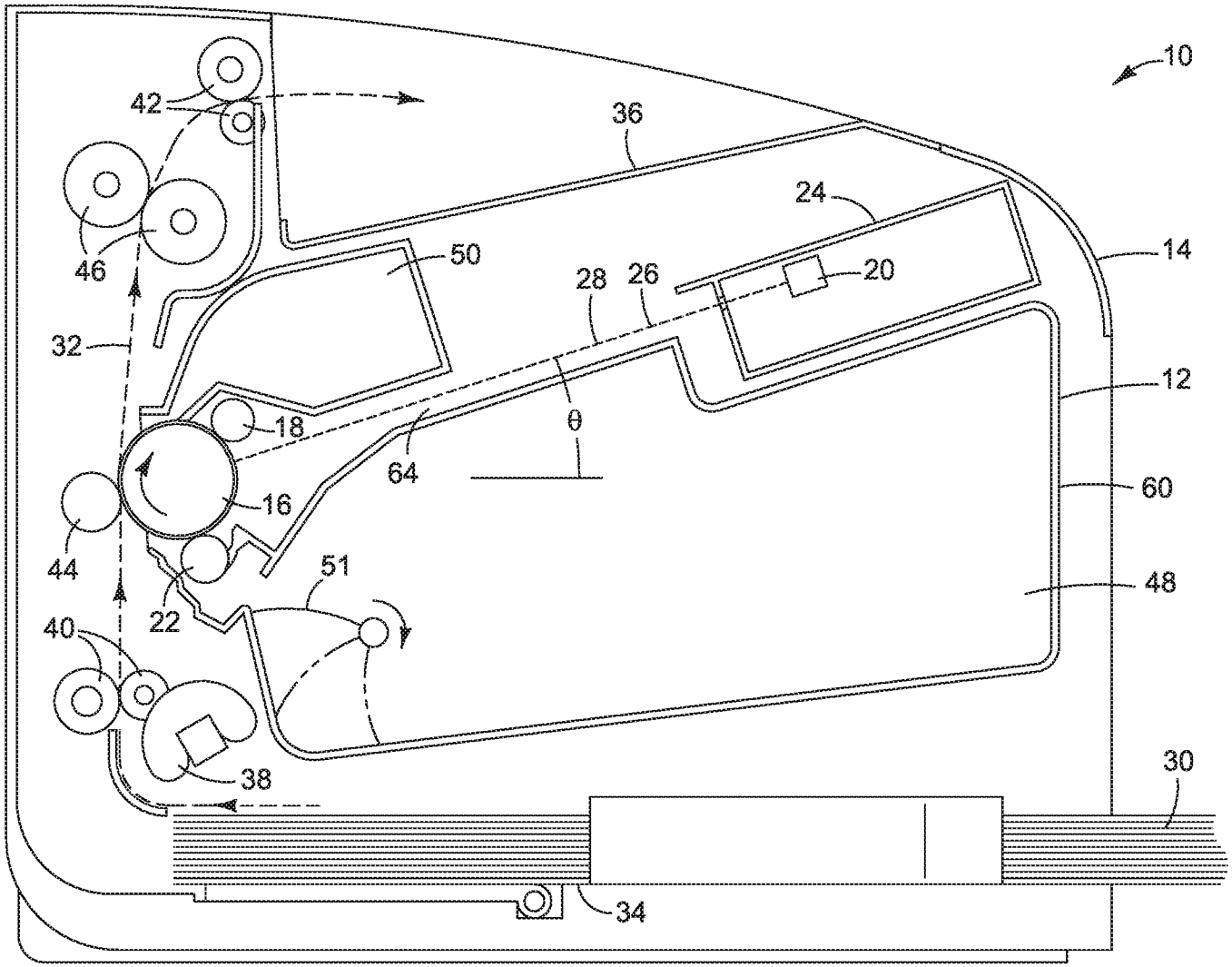
FIG. 9 is a side view illustrating one example of an electrophotographic printer and toner container in which the imaging light path is elevated at an acute angle above horizontal and the toner supply reservoir lies below the imaging light path.

FIG. 9 is an elevation view illustrating an electrophotographic printer 10 and toner container 12 in which imaging light path 28 is elevated and toner supply reservoir 48 lies below imaging light path 28. Referring to FIG. 9, imaging light module 24 is positioned high in printer housing 14 to elevate light path 28 at an acute angle θ above horizontal. This configuration creates additional space for storing toner below imaging path 28 and below light module 24. Accordingly, an enlarged toner supply may be housed in a single chamber toner supply reservoir 48 that lies entirely below imaging light path 28.

Less expensive laser printers currently leave about 10% of the toner as waste. Therefore, it may be desirable in some configurations for an enlarged toner container 12 to also increase the size of waste toner reservoir 50, as shown in FIG. 9. Alternatively, as shown in the example of FIGS. 8 and 9, an auger or other suitable transport mechanism 78 may be used to return waste toner to supply reservoir 48 as used toner accumulates in a smaller waste reservoir 50, and as the supply of fresh toner in reservoir 48 dwindles.

Figure 10:
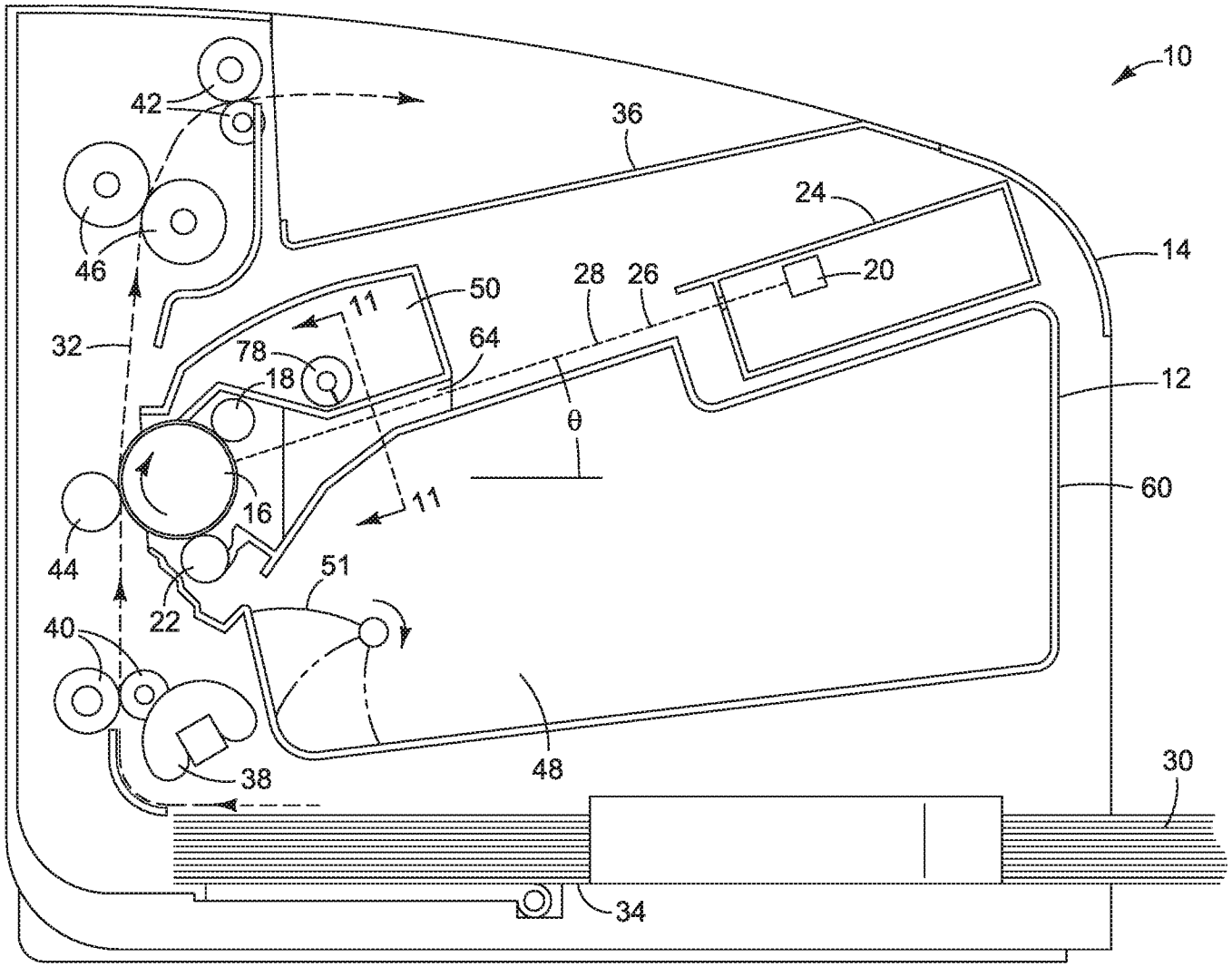
FIG. 10 is a side view illustrating one example of an electrophotographic printer and toner container in which the waste toner chamber is connected to the toner supply chamber so that used toner may be moved to the toner supply chamber.
Figure 11:
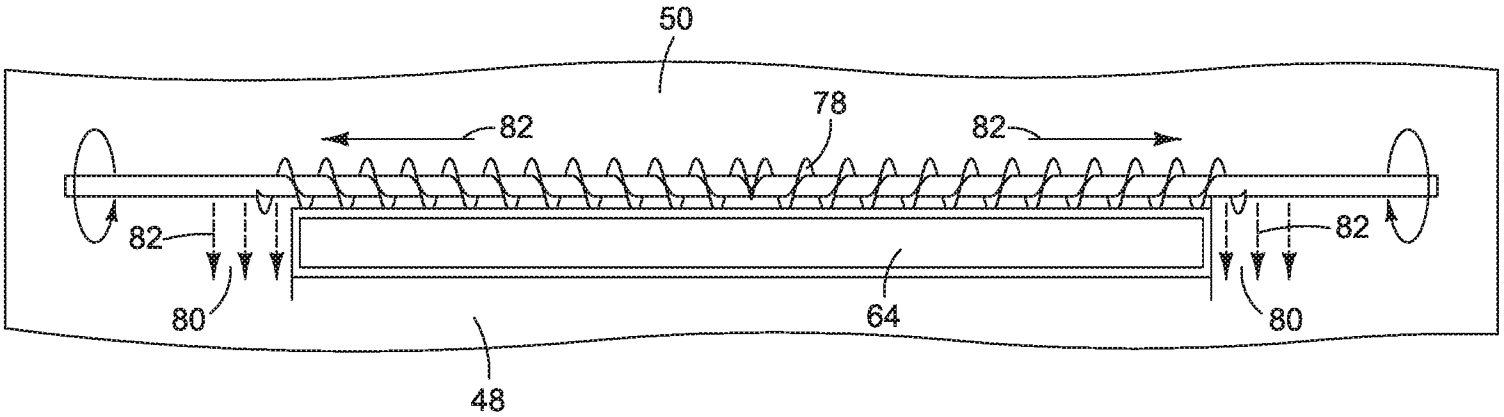
FIG. 11 is a section view taken along the lines 11-11 in FIG. 10.
Figure 12:
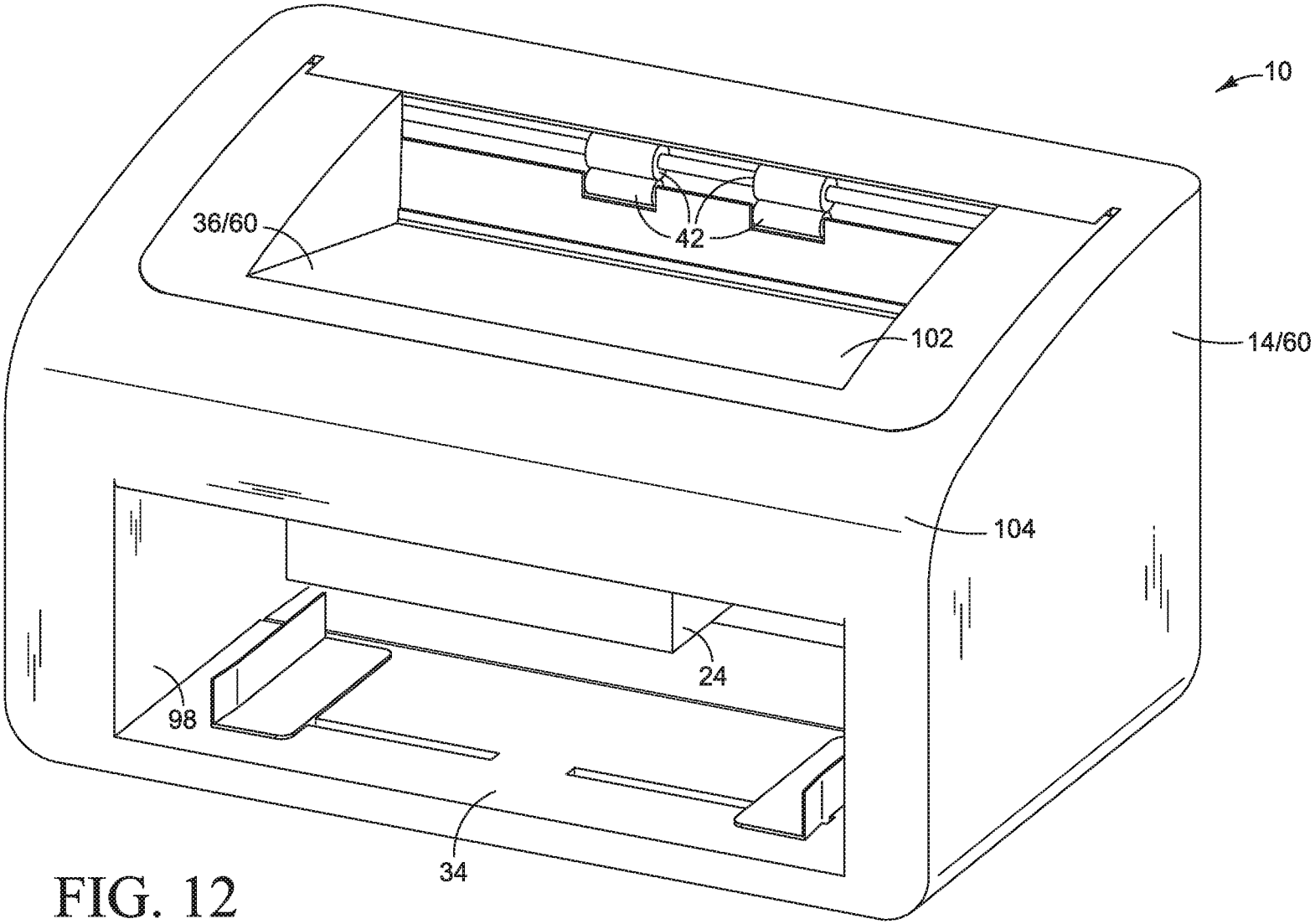
FIGS. 12 and 13 are perspective views illustrating one example of an electrophotographic printer and toner container in which the imaging light module and the toner container are combined into a single sub-assembly that is integrated into the printer housing.
Figure 13:
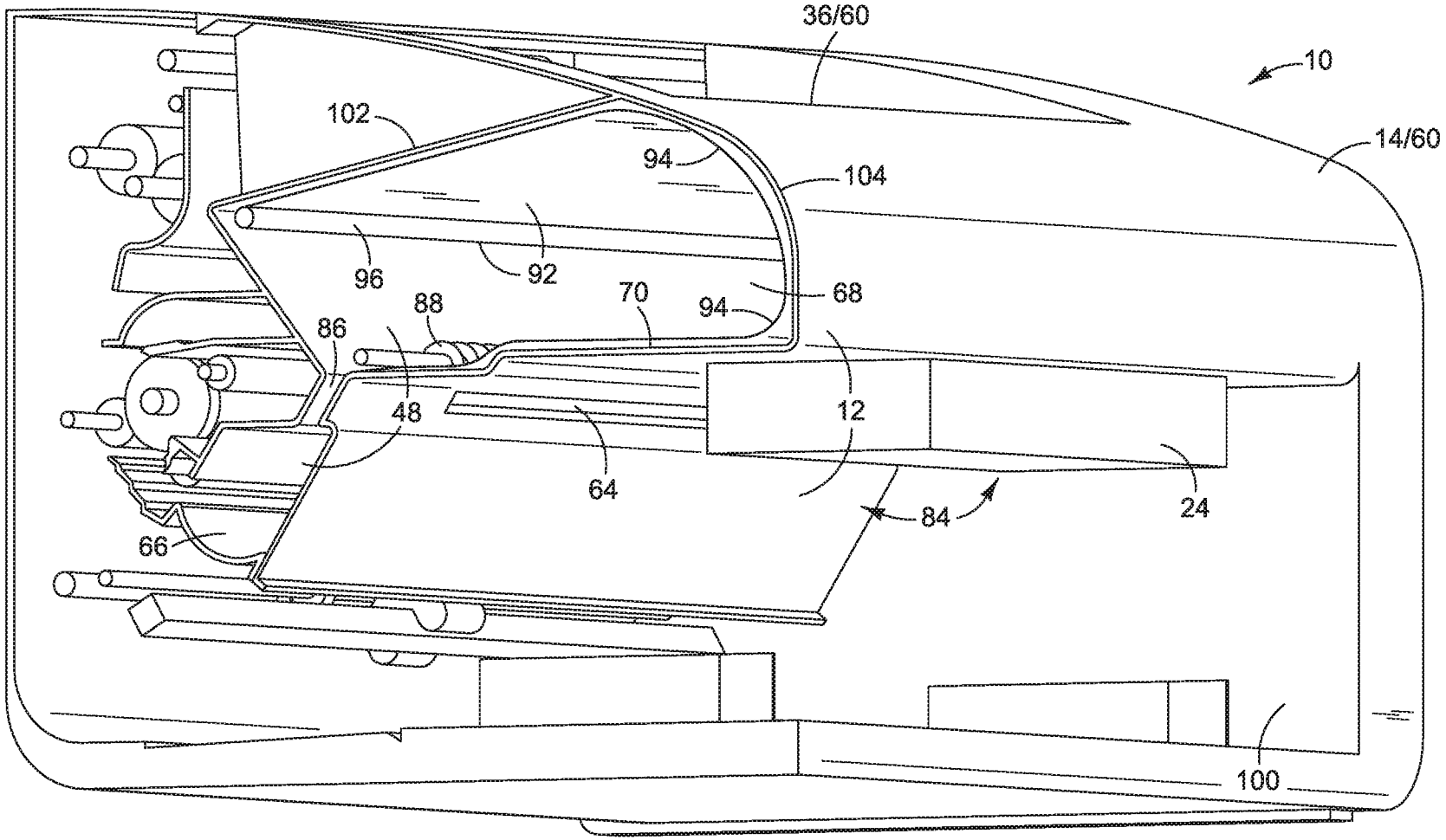
Figure 14:
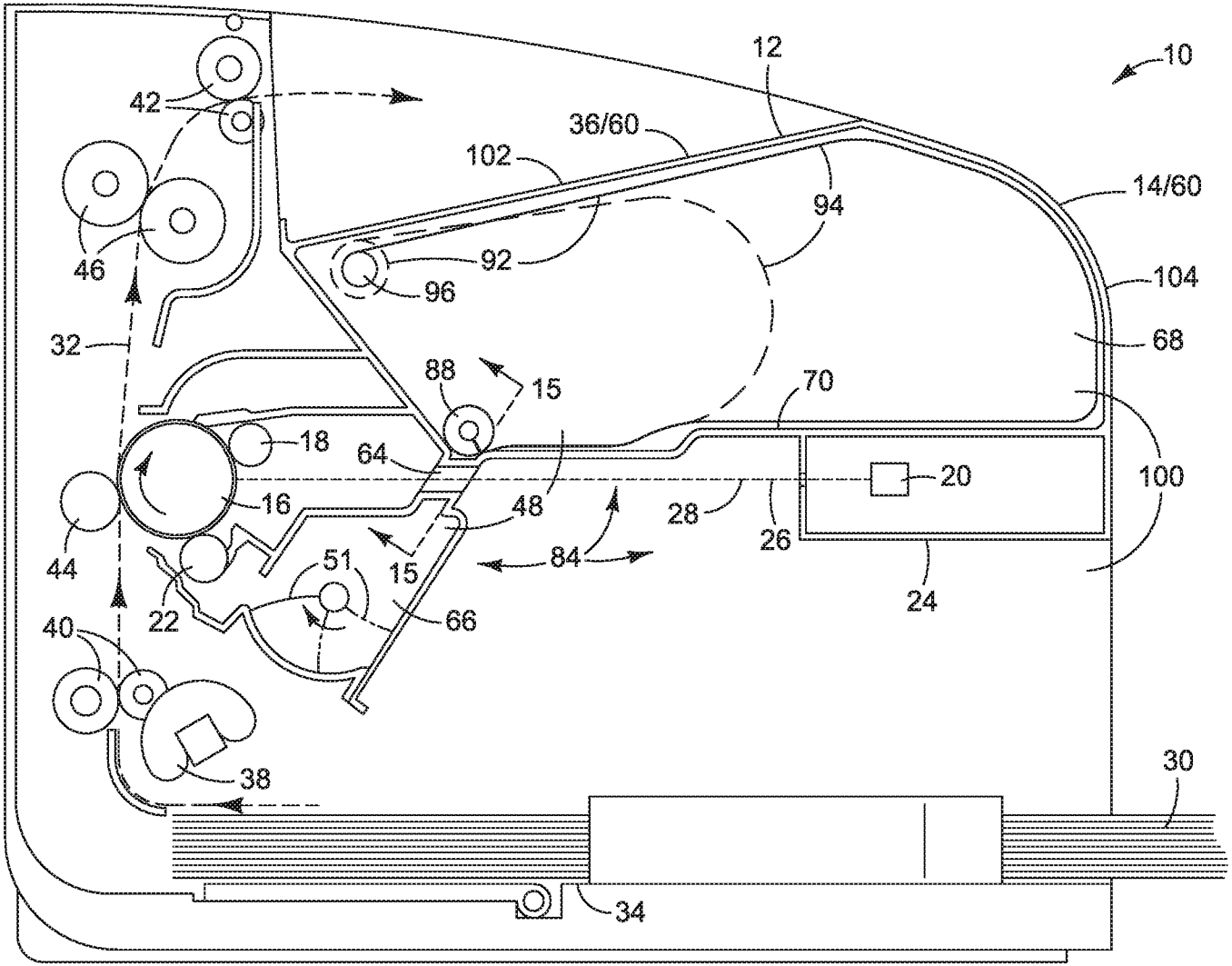
FIG. 14 is a side view of the printer and toner container shown in FIGS. 12 and 13.
Figure 15:
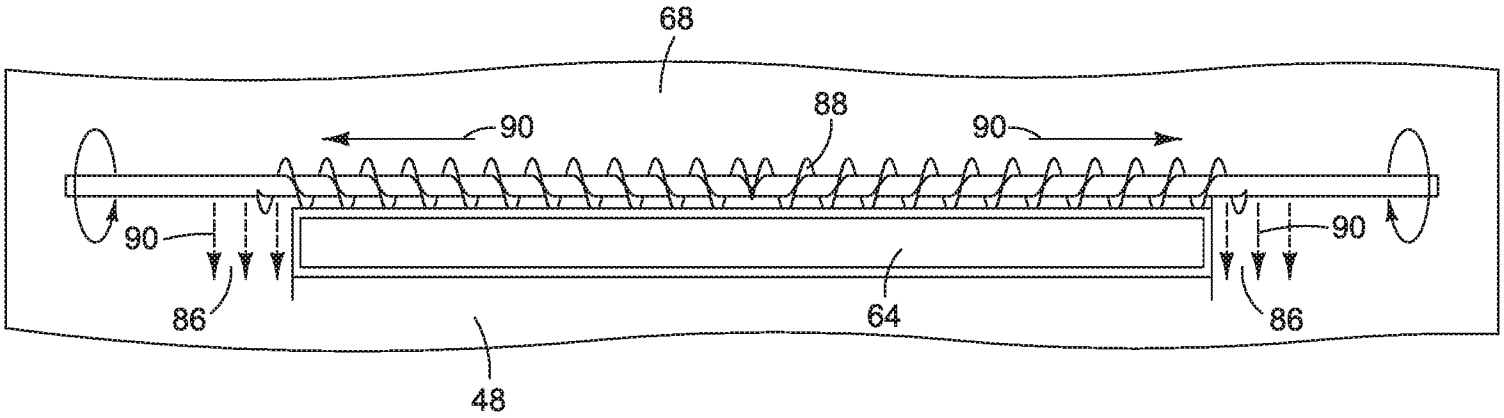
FIG. 15 is a section view taken along the line 15-15 in FIG. 14.

Referring to FIGS. 10 and 11, waste reservoir 50 is connected to supply reservoir 48 through channels 80 (FIG. 9) along both sides of an opening 64 that surrounds imaging light path 28. As best seen in FIG. 11, an auger 78 with opposing screw threads may be used to move waste toner simultaneously outboard to both channels 80, as indicated by direction/flow arrows 82. Waste toner channeled to supply reservoir 48 may be allowed to mix with the remaining fresh toner or a membrane (not shown) in supply reservoir 48 may be used to keep waste toner separate from the fresh toner.

FIGS. 12-15 illustrate an electrophotographic printer 10 and toner container 12 in which imaging light module 24 and toner container 12 are combined into a single sub-assembly 84 that is integrated into printer housing 14. (One side of printer housing 14 is removed in FIG. 13 to show the interior of toner container 12.) In some examples, a new enlarged toner container 12 makes it possible to eliminate the need for a replaceable toner cartridge, which, in turn, allows toner container 12 to be integrated as a permanent feature into the structure and/or exterior of printer 10.

Referring to FIGS. 12-15, toner supply reservoir 48 includes a smaller lower chamber 66 connected to a larger upper chamber 68 through channels 86 along both sides of an opening 64 that surrounds imaging light path 28. In this example for container 12, lower chamber 66 and the rearward part of container housing 60 mounting photoconductor 16, charging roller 18, and developer roller 22 use the same configuration as a conventional toner supply cartridge. This configuration for container 12 facilitates the adaptation of the new container for use in existing printer housings. An auger or other suitable transport mechanism 88 moves toner in upper chamber 68 to channels 86 where it can drop into lower chamber 66. As best seen in the section view of FIG. 15, an auger 88 with opposing screw threads may be used to move toner simultaneously to both channels 86, as indicated by direction/flow arrows 90.

In the example shown in FIGS. 12-15, the floor 70 of upper chamber 68 is substantially horizontal to help maximize storage capacity. Eventually, as the supply of toner in upper chamber 68 is depleted, the remaining toner will no longer flow to auger 88 at the urging of gravity alone. Hence, a collapsible liner or other suitable transport mechanism 92 is used to move the toner in upper chamber 68 to auger 88 where it can be channeled to lower chamber 66. Collapsible liner 92 is formed from a flexible sheet 94 lining chamber 68 and a winding roller 96. One end of sheet 94 is affixed to chamber floor 70 near auger 88 and the other end is affixed to roller 96. Sheet 94 is rolled onto roller 96 as the supply of toner in chamber 68 is depleted to shorten sheet 94 and shrink the volume of upper chamber 68, moving the remaining toner toward auger 88. A collapsing liner 92 is indicated by the dashed lines for sheet 94 in FIG. 14.

Imaging light module 24 is fastened to container housing 60 or otherwise integrated into container 12 to form a single sub-assembly 84. Container sub-assembly 84 is fastened to or otherwise integrated into printer housing 14 as a load bearing structure and/or as an exterior feature. In the example shown in FIGS. 12-14, container housing 60 (as part of sub-assembly 84) extends between (and includes) printer housing sidewalls 98, 100 across the front and interior portions of printer housing 14 to provide lateral structural support for printer 10. Sidewalls 98, 100, therefore, form part of printer housing 14 and part of container housing 60, and help define toner supply reservoir 48. Also, in this example the exterior top and forward portions 102, 104 of container housing 60 form the output tray 36 and the upper front exterior of printer housing 14, respectively.

Figure 16:
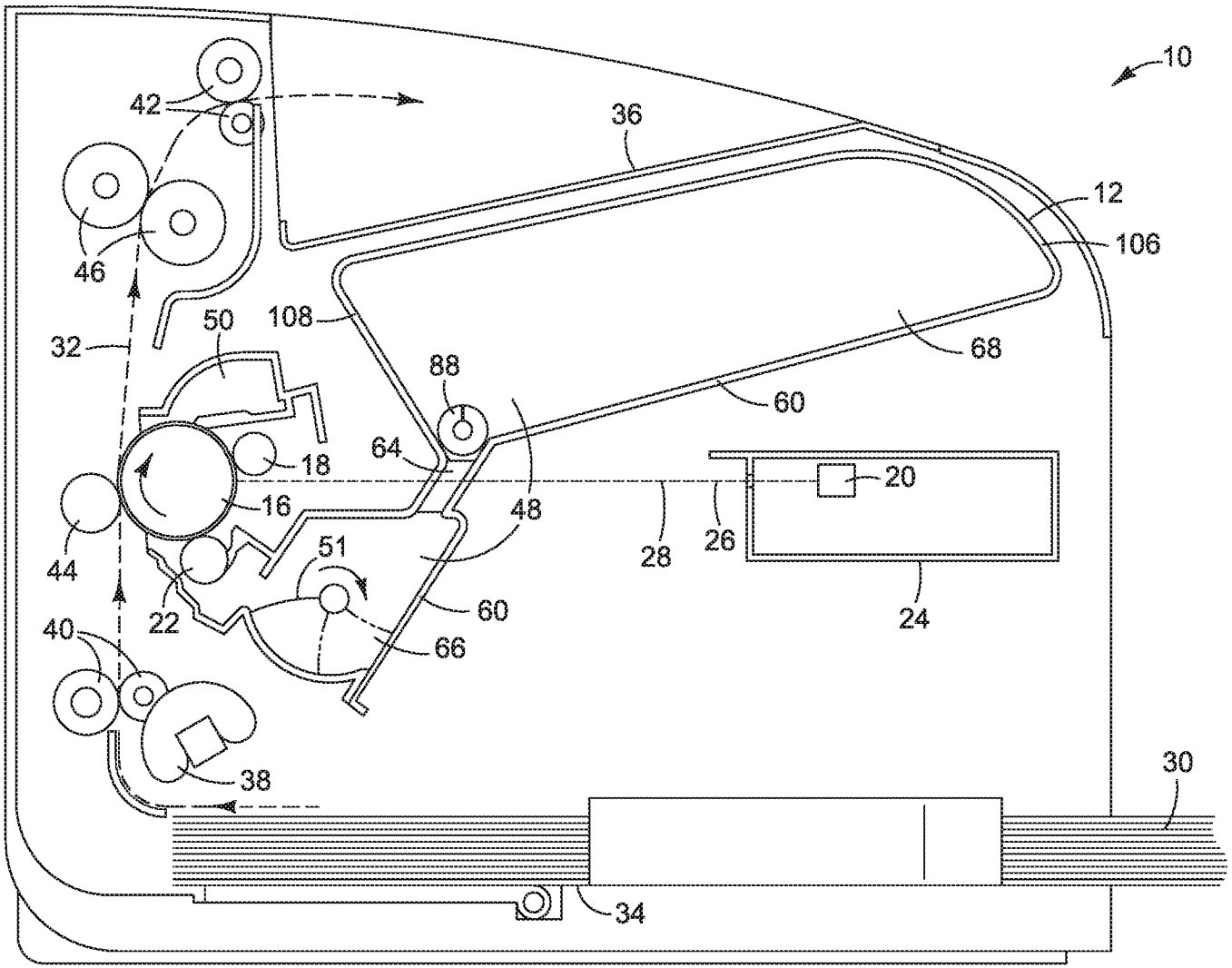
FIG. 16 is a side view illustrating another example of a toner container for an electrophotographic printer.

FIG. 16 is an elevation view illustrating another example of a new toner container 12 for an electrophotographic printer 10. FIG. 17 is a perspective view of toner container 12 from the printer of FIG. 16. FIGS. 18 and 19 are section views taken along the lines 18-18 and 19-19 in FIG. 17. The configuration of container 12 shown in FIGS. 16-19, is similar to the configuration of FIGS. 12-15 except that a sloped floor 70 in upper reservoir chamber 68 allows toner to move passively (under the influence of gravity) down to auger 88. The sloped floor decreases supply capacity but simplifies the design by eliminating the need for a collapsible liner or other such active transport mechanism to help move the toner to auger 88.

An example toner container for an electrophotographic printer, the toner container comprising a housing enclosing a toner supply reservoir having a capacity sufficient to store enough toner to print a minimum number of pages that corresponds to a predetermined expected useful life of the printer. In some examples, the printer includes a photoconductor and a light source for selectively exposing parts of the photoconductor to light; and when the container is installed in the printer, the toner supply reservoir at least partially surrounds the light source.

In some examples, the printer includes a photoconductor and a light source for selectively exposing parts of the photoconductor to light; and when the container is installed in the printer, the toner supply reservoir occupies space above and below the light source. In some examples, the printer includes a photoconductor at a rear part of the printer and a light source for selectively exposing parts of the photoconductor to light; and when the container is installed in the printer, the toner supply reservoir extends from the photoconductor at the rear of the printer to the front of the printer.

In some examples, the printer includes a photoconductor, a light source for selectively exposing parts of the photoconductor to a beam of light, and a light path along which the beam of light travels from the light source to the photoconductor, and at least part of the toner supply reservoir extends, when the container is installed in the printer: longitudinally a distance greater than the distance between the light source and the photoconductor; and laterally substantially the full axial length of the photoconductor. In some examples, the printer includes a photoconductor, a light source for selectively exposing parts of the photoconductor to a beam of light, and a light path along which the beam of light travels from the light source to the photoconductor, and: an exterior of the housing defines an opening through which a beam of light may pass along the light path when the container is installed in the printer; and an interior of the housing defines the supply reservoir, the supply reservoir surrounding the opening and including a lower chamber extending laterally under the opening and an upper chamber extending laterally over the opening, the upper chamber connected to the lower chamber at least at both sides of the opening along a full length of the opening.

In some examples, the minimum number of pages is more than 30,000 pages. In some examples, housing houses a photoconductor and a developer roller near the photoconductor for applying toner from the supply reservoir on to the photoconductor.

An example toner container for an electrophotographic printer having a photoconductor, a light source for selectively exposing parts of the photoconductor to a beam of light, and a light path along which the beam of light travels from the light source to the photoconductor, the container comprising a housing having an interior defining a toner supply reservoir that, when the container is installed in the printer, extends: longitudinally a distance greater than the distance between the light source and the photoconductor; and laterally substantially the full axial length of the photoconductor.

In some examples, the supply reservoir is defined in part by a floor and, when the container is installed in the printer, the floor slopes down from a front part of the supply reservoir to a rear part of the supply reservoir at an angle steep enough to move toner from the front part of the supply reservoir toward the rear part of the supply reservoir. In some examples, the supply reservoir surrounds the light path in a region between the light source and the photoconductor. In some examples, the housing has an exterior defining an opening in a region of the supply reservoir surrounding the light path, the opening configured to allow the light beam to pass through the opening when the container is installed in the printer.

In some examples, the toner container includes the light source, the light source supported by the housing at a location forward from the opening such that a light beam from the light source passes through the opening along the light path to the photoconductor when the container is installed in the printer.

In some examples, the toner container includes a waste chamber for holding used toner, the waste chamber isolated from the supply reservoir chamber such that toner in the waste chamber cannot pass into the supply reservoir. In some examples, the toner container includes a waste chamber for holding used toner, the waste chamber connected to the supply reservoir such that toner in the waste chamber may pass into the supply reservoir.

An example toner container for an electrophotographic printer having a photoconductor, a light source for selectively exposing parts of the photoconductor to a beam of light, and a light path along which the beam of light travels from the light source to the photoconductor, the container comprising: a housing having: an exterior defining an opening through which a beam of light may pass along the light path when the container is installed in the printer; and an interior defining a toner supply reservoir that includes a lower chamber extending laterally under the opening and an upper chamber connected to the lower chamber along both sides of the opening.

In some examples, at least part of the toner supply reservoir extends, when the container is installed in the printer: longitudinally a distance greater than the distance between the light source and the photoconductor; and laterally substantially the full axial length of the photoconductor.

In some examples, the opening surrounds the light path and the supply reservoir surrounds the opening such that the upper chamber extends laterally over the opening. In some examples, the toner container includes a transport mechanism for moving toner from the upper chamber toward the lower chamber. In some examples, the housing defines a floor of the upper chamber and the transport mechanism comprises a raised part of the floor at least over the opening. In some examples, the raised part of the floor forms a peak or a dome. In some examples, the transport mechanism comprises an auger in the upper chamber over the opening, the auger configured to move toner to the sides of the upper chamber where it can pass from the upper chamber to the lower chamber.

In some examples, the upper chamber is configured to channel toner toward the auger. In some examples, the auger is configured to move toner to both sides of the upper chamber simultaneously. In some examples, the toner container includes a collapsible liner lining the upper chamber and configured to move toner toward the transport mechanism. In some examples, the collapsible liner comprises a flexible sheet lining the upper chamber and a roller, the sheet having one end fixed at a lower part of the upper chamber and another end attached to the roller at an upper forward part of the upper chamber, and the roller rotatable to wind up the sheet to collapse the liner to shrink a volume of the upper chamber.

An example toner container for an electrophotographic printer having a photoconductor, a light source for selectively exposing parts of the photoconductor to a beam of light, and a light path along which the beam of light travels from the light source to the photoconductor, the toner container, comprising: a housing having an interior defining a toner supply reservoir, the housing defining at least a portion of the light path and a light source receptacle, the light source to be received in the light source receptacle, a step separating the light path and the light source receptacle, wherein the housing, when the toner container is installed in the printer, extends: longitudinally a distance greater than the distance between the light source and the photoconductor; and laterally substantially a full axial length of the photoconductor.

In some examples, the toner supply reservoir is defined at least partially by a floor and, when the container is installed in the printer, the floor slopes down from a front part of the toner supply reservoir to a rear part of the toner supply reservoir at an angle to move toner from the front part of the toner supply reservoir toward the rear part of the toner supply reservoir. In some examples, the toner supply reservoir at least partially surrounds the light path in a region between the light source and the photoconductor. In some examples, the housing surrounds the light path, the portion of the light path defined by the housing to enable the light beam to pass through the housing when the toner container is installed in the printer. In some examples, the toner cartridge includes the light source, the light source supported by the housing such that a light beam from the light source passes through the housing along the light path to the photoconductor when the toner container is installed in the printer.

In some examples, the toner container includes a waste chamber to hold used toner, the waste chamber being isolated from the toner supply reservoir. In some examples, the toner container includes a waste chamber to hold used toner, the waste chamber in communication with the toner supply reservoir. In some examples, the toner supply reservoir has a capacity sufficient to store enough toner to print a minimum number of pages that corresponds to a predetermined expected useful life of the printer.

In some examples, when the toner container is installed in the printer, the toner supply reservoir at least partially surrounds the light source. In some examples, when the toner container is installed in the printer, the toner supply reservoir occupies space above and below the light source. In some examples, the photoconductor is disposed at a rear part of the printer, the light source is to selectively expose parts of the photoconductor to light; and when the toner container is installed in the printer, the toner supply reservoir extends from the photoconductor at the rear of the printer toward a front of the printer.

In some examples, the toner supply reservoir includes a lower chamber and an upper chamber, the light path to be defined by the housing between the lower chamber and the upper chamber, the upper chamber to be fluidly coupled to the lower chamber to enable toner from the upper chamber to be received in the lower chamber. In some examples, the minimum number of pages is more than 30,000 pages. In some examples, the toner container houses a photoconductor and a developer roller near the photoconductor to apply toner from the toner supply reservoir on to the photoconductor.

In some examples, the toner container is integrally coupled within the printer. In some examples, the light source receptacle includes a lighting module integrally formed by the housing, the lighting module to house the light source. In some examples, the housing includes a tapered portion that extends though the toner supply reservoir, the tapered portion to at least partially define the light path, an exterior surface of the tapered portion to encourage movement of toner within the toner supply reservoir.

An example toner container for an electrophotographic printer, the printer having a photoconductor, a light source for selectively exposing parts of the photoconductor to a beam of light, and a light path along which the beam of light travels from the light source to the photoconductor, the toner container, comprising: a housing including a toner supply reservoir that includes a lower chamber and an upper chamber connected to the lower chamber; and a tapered portion that extends though the toner supply reservoir, the tapered portion to at least partially define the light path, an exterior surface of the tapered portion to encourage movement of toner within the toner supply reservoir.

In some examples, when the toner container is installed in the printer at least part of the toner supply reservoir extends: longitudinally a distance greater than the distance between the light source and the photoconductor; and laterally substantially a full axial length of the photoconductor. In some examples, the tapered portion surrounds the light path. In some examples, the toner container includes a transport mechanism to move the toner from the upper chamber toward the lower chamber. In some examples, the tapered portion is to move toner from the upper chamber toward the lower chamber. In some examples, the tapered portion forms a peak or a dome. In some examples, the toner container includes an auger in the upper chamber, the auger to move toner to sides of the upper chamber to enable the toner to pass from the upper chamber to the lower chamber.

In some examples, the upper chamber is to channel toner toward the auger. In some examples, the auger is to move toner to both sides of the upper chamber substantially simultaneously. In some examples, the toner container includes a collapsible liner lining the upper chamber, the collapsible liner to move toner toward the transport mechanism. In some examples, the collapsible liner includes a flexible sheet lining the upper chamber and a roller, the sheet having one end fixed at a lower part of the upper chamber and another end attached to the roller at an upper forward part of the upper chamber, the roller rotatable to wind up the sheet to collapse the liner to shrink a volume of the upper chamber.

In one example, a toner container for an electrophotographic printer includes a toner supply reservoir having a capacity sufficient to store enough toner to print a minimum number of pages that corresponds to a predetermined expected useful life of the printer. In another example, a toner container for an electrophotographic printer includes a toner supply reservoir that, when the container is installed in the printer, extends longitudinally a distance greater than the distance between the light source and the photoconductor and laterally substantially the full axial length of the photoconductor. In another example, a toner container for an electrophotographic printer includes an opening for the imaging light beam and a toner supply reservoir that includes a lower chamber extending laterally under the opening and an upper chamber connected to the lower chamber along both sides of the opening.

As noted at the beginning of this Description, the examples shown in the figures and described above illustrate but do not limit the invention. Other examples, embodiments and implementations are possible. Therefore, the foregoing description should not be construed to limit the scope of the invention, which is defined in the following claims.

What is claimed is:

1. A toner cartridge for a printer, comprising:

a housing;

a photoconductor supported in the housing;

a developer roller supported in the housing adjacent to the photoconductor; and the housing including:

an exterior defining an opening through which imaging light may pass through the housing along an imaging light path that extends longitudinally toward the photoconductor, the opening diverging along the imaging light path laterally across a width of the housing from a narrower upstream part to a broader downstream part at the photoconductor; and an interior region defining a toner supply reservoir surrounding the opening, the toner supply reservoir having a lower chamber below the opening to supply toner to the developer roller directly, an upper chamber above the opening to supply toner to the developer roller indirectly through the lower chamber, and a channel on each side of the opening connecting the upper chamber and the lower chamber, the upper chamber defined in part by a floor that slopes down laterally away from a higher part over the opening to a lower part at each channel.

2. The toner cartridge of claim 1, where the floor forms a dome or a peak at the higher part.

3. The toner cartridge of claim 1, where the toner supply reservoir has a capacity sufficient to store enough toner to print a minimum number of pages that corresponds to a predetermined expected useful life of the printer.

4. The toner cartridge of claim 1, where the photoconductor and the developer roller are supported in the housing in the same configuration as a conventional toner cartridge.

5. The toner cartridge of claim 1, where the housing is adapted for use in an existing printer housing.

6. A toner cartridge for a printer, comprising interconnected interior upper and lower toner supply chambers surrounding an exterior opening defined in part by diverging sidewalls and a sloping ceiling.

7. The toner cartridge of claim 6, where the ceiling slopes from a peak at a middle part of the opening down to each of the diverging sidewalls.

8. The toner cartridge of claim 7, where the toner supply chambers are connected along the diverging sidewalls.

9. The toner cartridge of claim 8, comprising:

a photoconductor; and a developer roller adjacent to the photoconductor to receive toner from the lower supply chamber and apply toner to the photoconductor.

10. The toner cartridge of claim 9, comprising an imaging light module.

* * * * *